US012196436B2

(12) United States Patent
DeRossett et al.

(10) Patent No.: US 12,196,436 B2
(45) Date of Patent: Jan. 14, 2025

(54) DEHUMIDIFIER

(71) Applicant: Midea Group Co., Ltd., Foshan (CN)

(72) Inventors: Andrew DeRossett, Shelbyville, KY (US); Zachary Chapin, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 106 days.

(21) Appl. No.: 17/708,873

(22) Filed: Mar. 30, 2022

(65) Prior Publication Data

US 2023/0314013 A1 Oct. 5, 2023

(51) Int. Cl.

| | |
|---|---|
| ***F24F 1/0358*** | (2019.01) |
| ***F24F 1/0287*** | (2019.01) |
| ***F24F 11/89*** | (2018.01) |
| ***F24F 13/20*** | (2006.01) |
| ***F24F 13/22*** | (2006.01) |

(52) U.S. Cl.

CPC ..... *F24F 1/0358* (2019.02); *F24F 11/89* (2018.01); *F24F 13/20* (2013.01); *F24F 13/222* (2013.01); *F24F 1/0287* (2019.02)

(58) Field of Classification Search

CPC ..... F24F 1/0358; F24F 11/89

See application file for complete search history.

(56) References Cited

U.S. PATENT DOCUMENTS

| | | | |
|---|---|---|---|
| 5,729,994 | A | 3/1998 | Mukaiyama |
| 6,199,428 | B1 | 3/2001 | Estevez-Garcia et al. |
| 6,210,566 | B1 | 4/2001 | King |
| 6,370,902 | B1 | 4/2002 | De' Longhi |
| 7,490,706 | B2 | 2/2009 | Robertson |
| 7,671,754 | B2 | 3/2010 | Heilmann et al. |
| 7,821,411 | B1 | 10/2010 | Ward |
| 8,172,154 | B1 | 5/2012 | Figley et al. |
| 8,181,939 | B2 | 5/2012 | Yoon |
| 8,196,422 | B2 | 6/2012 | Ritchey |
| 8,292,117 | B2 | 10/2012 | Guibert |
| 8,869,548 | B2 | 10/2014 | Piccione |

(Continued)

FOREIGN PATENT DOCUMENTS

| | | |
|---|---|---|
| CN | 1590879 A | 3/2005 |
| CN | 2926888 Y | 7/2007 |

(Continued)

OTHER PUBLICATIONS

KR20150103909A Translation (Year: 2015).*

(Continued)

*Primary Examiner* — Schyler S Sanks
(74) *Attorney, Agent, or Firm* — Gray Ice Higdon

(57) ABSTRACT

A dehumidifier with a nesting sensor is provided. The dehumidifier system includes a condensate tank and a dehumidifier that may be positionable between at least one deployed configuration and at least one stowed configuration relative to the condensate tank. The stowed configuration has the apparatus nested within an internal volume of the condensate tank. The dehumidifier system includes a protuberance on the bottom of the condensate tank to activate a switch of the dehumidifier, and a magnet on the bottom of the condensate tank to activate a Hall-effect sensor of the dehumidifier.

22 Claims, 13 Drawing Sheets

(56) References Cited

U.S. PATENT DOCUMENTS

| | | | | |
|---|---|---|---|---|
| 8,994,812 | B2 | 3/2015 | Giordano et al. | |
| 9,074,812 | B2 | 7/2015 | Rowland | |
| 9,958,182 | B1 | 5/2018 | Rimmer | |
| 10,031,041 | B2 | 7/2018 | Franz et al. | |
| 10,458,730 | B2 | 10/2019 | Lorang et al. | |
| 10,473,355 | B2 | 11/2019 | O'Brien | |
| 10,578,481 | B2 | 3/2020 | Myeong et al. | |
| 10,677,479 | B2 | 6/2020 | Andersson | |
| 10,788,230 | B2 | 9/2020 | Williams | |
| 10,830,490 | B2 | 11/2020 | Rokade et al. | |
| 10,900,676 | B2 | 1/2021 | Swanson et al. | |
| 11,077,399 | B2 | 8/2021 | Choi et al. | |
| 2003/0066298 | A1 | 4/2003 | Yang | |
| 2004/0040322 | A1 | 3/2004 | Engel | |
| 2006/0258916 | A1 | 11/2006 | Pietersen | |
| 2014/0102296 | A1 | 4/2014 | Pendergrass | |
| 2014/0150488 | A1 | 6/2014 | Black et al. | |
| 2015/0276241 | A1 | 10/2015 | Jeon et al. | |
| 2016/0153824 | A1* | 6/2016 | Myeong | F24F 13/222 73/306 |
| 2017/0185276 | A1 | 6/2017 | Lee et al. | |
| 2017/0336093 | A1 | 11/2017 | Huang et al. | |
| 2018/0172290 | A1 | 6/2018 | Zhou | |
| 2018/0372371 | A1 | 12/2018 | Demonte | |
| 2019/0055691 | A1 | 2/2019 | Tong | |
| 2019/0137121 | A1 | 5/2019 | Swanson et al. | |
| 2019/0137131 | A1 | 5/2019 | Sako et al. | |
| 2019/0232213 | A1 | 8/2019 | Dios | |
| 2019/0323714 | A1 | 10/2019 | Cui | |
| 2020/0011556 | A1 | 1/2020 | Williams | |
| 2020/0061532 | A1 | 2/2020 | Yoon et al. | |
| 2020/0116392 | A1 | 4/2020 | Gardner et al. | |
| 2020/0182490 | A1 | 6/2020 | Li | |
| 2021/0332990 | A1 | 10/2021 | Yang et al. | |
| 2021/0333010 | A1 | 10/2021 | Yang et al. | |
| 2023/0018141 | A1 | 1/2023 | Derossett | |
| 2023/0194106 | A1 | 6/2023 | Leezer | |

FOREIGN PATENT DOCUMENTS

| | | | | |
|---|---|---|---|---|
| CN | 201411571 | Y | | 2/2010 |
| CN | 202747574 | U | | 2/2013 |
| CN | 105387534 | A | | 3/2016 |
| CN | 106482317 | A | | 3/2017 |
| CN | 206338879 | U | | 7/2017 |
| CN | 107238146 | A | | 10/2017 |
| CN | 207065748 | U | | 3/2018 |
| CN | 207094850 | U | | 3/2018 |
| CN | 108244846 | A | | 7/2018 |
| CN | 109425043 | A | | 3/2019 |
| CN | 110748988 | | | 2/2020 |
| CN | 111140989 | A | | 5/2020 |
| CN | 211476138 | U | | 9/2020 |
| CN | 110079982 | B2 | | 4/2021 |
| CN | 213713516 | U | | 7/2021 |
| EP | 2832920 | A1 | | 2/2015 |
| EP | 3872407 | A1 | | 9/2021 |
| JP | S62136213 | U | | 8/1987 |
| JP | H0665360 | B2 | | 8/1994 |
| JP | 2591726 | B2 | | 3/1997 |
| JP | 2009089995 | A | | 4/2009 |
| JP | 2013240406 | A | | 12/2013 |
| JP | 5887478 | B2 | | 3/2016 |
| JP | 3221820 | U | | 6/2019 |
| KR | 20150103909 | A | * | 9/2015 |
| KR | 20160013477 | A | | 2/2016 |
| KR | 20160054723 | A | | 5/2016 |
| WO | WO93/14353 | A1 | | 7/1993 |
| WO | WO2006013653 | A1 | | 2/2006 |

OTHER PUBLICATIONS

Sheth, Sarang, The Foldable Dehumidifier Has a Bellow-Shaped Water Tank That Expands as it Fills Up, Yanko Design, GREE Electric Appliances Inc., www.yankdesign.com/author/sarangsheth, Oct. 24, 2019.

International Search Report and Written Opinion issued in Application No. PCT/CN2020/086640 dated Jan. 13, 2021.

U.S. Patent and Trademark Office, Office Action issued in U.S. Appl. No. 16/764,772 dated Sep. 21, 2021.

Putri, Dewi et al., Design and Performance Analysis of Smart Roof Clothesline System Based on Microcontroller by Smartphone Application, School of Electrical Engineering, Telkom University, Dec. 20, 2018.

Belin, Belin Brand BL-890D 90L (150) Pint R410a without water tank drainage directly commercial industrial dehumidifier, alibaba.com, Retrieved from: https://www.alibaba.com/product-detail/BELIN-brand-BL-890D-90L-150Pint_60447146179.html?spm=a2700.7724857.normal_offer.d_title.79fb5cd7iHcdoL, Retrieved on Mar. 23, 2021.

Innovative Dehumidifier Systems, Tankless Dehumidification System Independent of HVAC, IW25-4 In Wall/ On Wall Dehumidifier, Retrieved from: https://www.innovativedehumidifiers.com/dehumidification-system/, Retrieved on Mar. 23, 2021.

Related Applications Transmittal dated Mar. 30, 2022.

Sullens, Tavia L., United States Patent and Trademark Office, Final Office Action issued in U.S. Appl. No. 16/875,847, 35 pages, dated Apr. 20, 2023.

United States Patent and Trademark Office; Final Rejection Issued in U.S. Appl. No. 16/764,772; 42 pages; dated Dec. 16, 2022.

Tadesse, Martha, United States Patent and Trademark Office, Notice of Allowance issued in U.S. Appl. No. 16/764,772, 23 pages, dated Jul. 6, 2023.

Sullens, Tavia L., United States Patent and Trademark Office, Non-Final Office Action issued in U.S. Appl. No. 16/875,847, 43 pages, dated Sep. 8, 2023.

U.S. Patent and Trademark Office, Office Action issued in U.S. Appl. No. 16/764,772 dated May 26, 2022.

Sullens, Tavia L, United States Patent and Trademark Office, Office Action issued in U.S. Appl. No. 16/875,847, 81 pages, dated Sep. 1, 2022.

Sullens, Tavia L., United States Patent and Trademark Office, Notice of Allowance issued in U.S. Appl. No. 16/875,847, 30 pages, dated Feb. 21, 2024.

Nouketcha, Lionel W., United States Patent and Trademark Office, Non-Final Office Action issued in U.S. Appl. No. 17/559,404, 74 pages , dated Apr. 3, 2024.

Nouketcha, Lionel W., United States Patent and Trademark Office, Notice of Allowance issued in U.S. Appl. No. 17/559,404, 24 pages, dated Sep. 18, 2024.

* cited by examiner

DEHUMIDIFIER

BACKGROUND

Portable dehumidifiers are used in many homes to reduce the humidity in an interior environment. Portable dehumidifiers typically include a refrigeration circuit including an evaporator that absorbs heat, a condenser that expels heat, and a compressor that circulates refrigerant through the circuit. A fan draws moist air into the dehumidifier and over the evaporator to cool the air and cause water vapor in the air to condense on the surface of the evaporator. The now-dehumidified air then continues across the condenser to reheat the air, prior to exiting the dehumidifier. Condensed water may also be collected in a tank for later disposal by a user, or in some instances, the collected water may be diverted directly to a drain, with a condensate pump used in some instances when an insufficient head exists to induce drainage through gravity alone. Many portable dehumidifiers also include a user interface that enables a user to set a particular humidity level as a setpoint, so that a portable dehumidifier will shut off once the desired humidity level is reached and turn back on once the humidity level rises again.

Portable dehumidifiers are often used in areas of a home that are routinely subjected to higher humidity levels such as basements and bathrooms, as excessive humidity can lead to mold growth and structural damage in a home. However, in many geographical regions, excessive humidity can be seasonal, as humidity generally drops during colder winters due to the fact that colder air is capable of retaining less water vapor than warmer air. As such, the portability of such dehumidifiers is often a benefit since they can be moved to different areas of the home as needed, and may also be stored away when not in use.

Typical dehumidifiers, however, comprise a constant size or constant shape appliance. This may lead to problems including, but not limited to, storing, transporting, and/or shipping of a system that may have a large shape and/or outer dimension that undesirably increases the space needed for storage/shipping and/or increases transportation costs. The present embodiments relate to a dehumidifier integrated with a condensate tank in which the dehumidifier can nestingly stack. An example of such an appliance is disclosed in commonly-owned U.S. patent application Ser. No. 16/875,847, filed on May 15, 2020, the entire contents of which are incorporated herein by reference. In such a dehumidifier, it would be beneficial to know when, or whether, the humidifier is nested within its tank, so as to be able to ensure it does not operate while in that configuration. Therefore, the present embodiments are directed to an improved safety system and method for detecting when a dehumidifier is nested within its condensate tank.

SUMMARY

The herein-disclosed embodiments address these and other problems associated with the art. In the described embodiments, for example, a dehumidifier system includes a dehumidifier apparatus and a condensate tank in which the dehumidifier can nest or telescopically retract in a first, or stored, configuration, and can reside upon or telescopically extend into a second, or deployed (that is, operating) configuration. Embodiments of the portable dehumidifier have a switch and a condensate tank having a first protuberance at a first location and a second protuberance at a second location, wherein, depending on whether the dehumidifier is in the stored or in the deployed configuration, either the first protrusion or the second protrusion activates the switch.

In some embodiments, a dehumidifier has a dehumidifier housing having a bottom, one or more sidewalls, and a top, wherein the housing includes at least a compressor, a condenser, an evaporator, a fan, a switch, and a Hall-effect sensor. The dehumidifier system also includes a condensate tank further comprising a condensate tank housing having a bottom, one or more sidewalls, and a rim defining an opening into an internal volume within said condensate tank housing. The dehumidifier housing is configured to occupy a plurality of configurations with respect to the condensate tank, including a first configuration in which the dehumidifier housing is atop the condensate tank, and a second configuration in which the dehumidifier housing is nested within the internal volume of the condensate tank. A portion of the internal volume of the condensate tank is unoccupied by the dehumidifier housing when the dehumidifier housing is in the first configuration, and a portion of the internal volume of the condensate tank is occupied by the dehumidifier housing when the dehumidifier housing is in the second configuration. The condensate tank housing has a ledge adjacent the opening. The condensate tank includes at least one float coupled thereto that is configured to rise with a predetermined level of liquid within the internal volume of the condensate tank. A first protuberance is located at a first location on the condensate tank, and a second protuberance is located at a second location on the condensate tank. A magnet is coupled to the bottom of the condensate tank and is located beneath and in close proximity to the Hall-effect sensor when the condensate tank is in said second configuration.

In some embodiments, a system for determining whether a dehumidifier is nested within a condensate tank is disclosed. The system includes a dehumidifier having a compressor, a condenser, an evaporator, a fan, a switch, and a Hall-effect sensor. The system also includes a condensate tank having a housing configured to receive thereatop the dehumidifier in a first configuration and configured to receive therewithin the dehumidifier in a second configuration. A first protuberance is at a first location near a top of the condensate tank, and a second protuberance is at a second location near a bottom of the condensate tank. A magnet is located at a bottom of the condensate tank housing and located beneath and in close proximity to the Hall-effect sensor when the condensate tank is in the second configuration. A controller is included that is configured to receive a signal from the switch when the switch is activated by the second protuberance, and is configured to receive a voltage output from the Hall-effect sensor when the condensate tank is in the second configuration. The controller is configured to activate an Off mode when the signal is received from the switch and the voltage output is received from the Hall-effect sensor.

In some embodiments, various improvements to a nesting dehumidifier are provided. Such a dehumidifier has a dehumidifier housing and a separable condensate tank, and the dehumidifier housing is configured to occupy a first position atop the condensate tank and a second position within the condensate tank. The improvements include a switch located on the dehumidifier housing and a Hall-effect sensor located on the dehumidifier housing configured to send a voltage output when a predetermined magnetic field is present. The improvements also include a first protuberance at a first location on the condensate tank and a second protuberance at a second location on the condensate tank. The first protuberance activates the switch when the dehumidifier housing is in the first configuration and the second protuberance activates the switch when the dehumidifier housing is in the second configuration. A magnet is located at a bottom of the condensate tank housing and in a location that is beneath and in close proximity to the Hall-effect sensor when the condensate tank is in the second configuration. A controller is also included and is configured to receive a signal from the switch when the switch is activated by the second protuberance, and is configured to receive the voltage output from the Hall-effect sensor when the condensate tank is in the second configuration. The controller also is configured to activate an Off mode when the signal is received from the switch and the voltage output is received from the Hall-effect sensor.

These and other advantages and features, which characterize the invention, are set forth in the claims annexed hereto. For a better understanding of the invention, and of the advantages and objectives attained through its use, reference should be made to the Figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
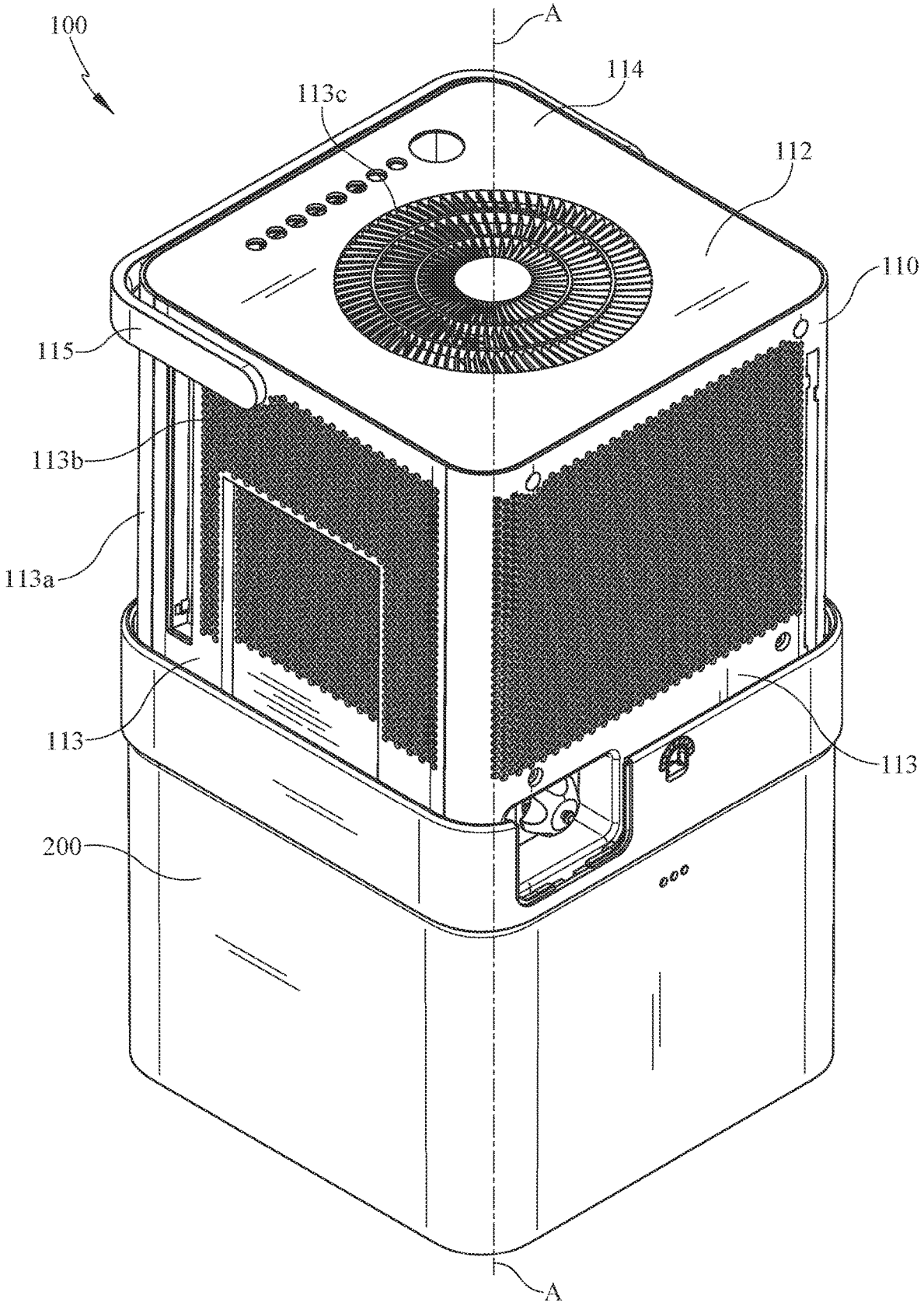
FIG. 1 is a perspective view of an embodiment of a dehumidifier in a deployed/operating configuration.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques and apparatuses within a portable nesting dehumidifier system, such as the type that may be used in single-family or multi-family dwellings, or in other similar applications. However, it will be appreciated that the herein-described techniques may also be used in connection with other types of dehumidifying apparatus in some embodiments. For example, the herein-described techniques may be used in commercial applications and/or non-portable embodiments.

Turning now to the drawings, wherein like numbers denote like parts throughout the several views, an example dehumidifier 100 is shown in FIGS. 1-4 in which the various technologies and techniques described herein may be implemented. The dehumidifier 100 may efficiently utilize a given space and provides for convenient storage, shipping, handling, operating, etc. The dehumidifier 100 includes a dehumidifier apparatus 114 having a housing 110 that contains various functional components of the apparatus 114, including, but not limited to, a condenser 120, an evaporator 130, a compressor 140, a fan 150, and a motor 160. These functional components are not depicted in the figures because they are well-known in the art and not relevant to the main purpose of this disclosure. The housing 110 includes a bottom 111, a top 112, and multiple sidewalls 113 connecting the bottom 111 to the top 112, thereby creating the enclosed apparatus 114. In the figures, the apparatus 114 is depicted as a generally cuboidal shape. However, any number of shapes, sizes, constructions, and quantities of the apparatus 114 of the dehumidifier 100 are possible within the scope of the invention. In the embodiment shown in the figures, the sidewalls 113 form an outer periphery 113*a*, and this outer periphery 113*a* may be engageable to, and nestable within, a condensate tank 200 in stacking, nesting, and/or telescoping fashion (discussed below).

The apparatus 114 can optionally include a handle 115, either fixed or moveable, to facilitate lifting, carrying, and placing the dehumidifier 100. The dehumidifier 100 further includes multiple air inlets 113*b* and air outlets 113*c*. In the figures the air inlets 113*b* are shown on the sidewalls 113, and the air outlets 113*c* are shown on the top 112. The dehumidifier 100 also would typically include a power cable (not shown) electrically connected to the motor 160 and the fan 150, and associated wiring for the condenser 120, evaporator 130, and compressor 140, in known fashion for such appliances, for providing power to the apparatus 114.

The apparatus 114 also includes a switch 170, preferably located on the bottom 111. The switch 170 can be any of the commonly known types of switches, for example, but not limited to, push button, toggle, slide, and the like. The switch 170 is preferably mechanical, with activation being made by a protuberance (discussed below) physically pressing or sliding a lever of the switch 170 to engage the contacts therein, but obviously could also be electronic if desired. Also preferably, but not necessary, the switch 170 lever is spring-loaded into the open position, such that its contacts are not closed until the lever is urged against a spring bias force to close the contacts. The switch 170 is used in the logical control system (described below) to detect the presence or absence of the condensate tank 200.

Figure 4:
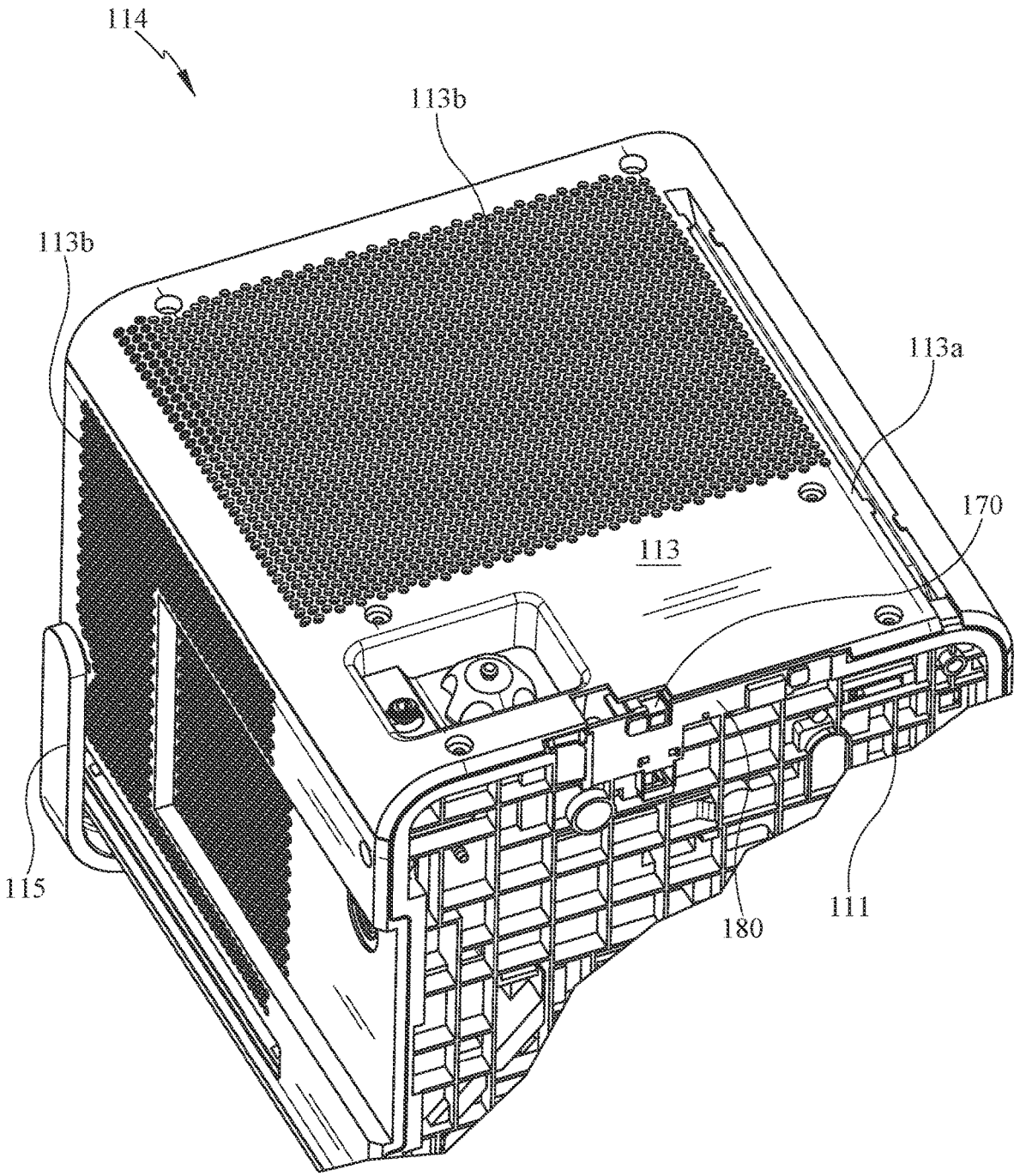
FIG. 4 is bottom perspective close-up view of the dehumidifier apparatus according to an embodiment.

With reference in particular to FIG. 4, the switch 170 works in concert with one or more Hall-effect sensors, also located on the apparatus 114, preferably at the bottom 111 and adjacent the switch 170. A Hall-effect sensor, as is well-known in the electronics field, is a magnetically-activated contactless trigger. Hall-effect sensors detect magnetic fields and change their output voltage based on the presence of a magnetic field of a certain magnitude and/or direction. The Hall-effect sensor preferred herein actually contains two such sensors (a first Hall-effect sensor 181 and a second Hall-effect sensor 182) housed in a Hall-effect sensor assembly 180, utilizing the same power and ground wires. Separate Hall-effect sensors 181, 182 in individual housings could used, if desired. In the figures, the locations of the first Hall-effect sensor 181 and the second Hall-effect sensor 182 are indicated in dashed boxes for purposes of representation. In the embodiments shown, the first Hall-effect sensor 181 and second Hall-effect sensor 182 receive 5 volts from the same line and use the same ground line. Each sensor has its own data wire that sends a return signal to the controller 191 (described below). As used in the embodiments herein described, the magnetic fields used to activate the first Hall-effect sensor 181 and/or the second Hall-effect sensor 182 are provided, in various configurations of the apparatus 114 with respect to the condensate tank 200, by one or more of three magnets: a first magnet 216, a first float magnet 233, and a second float magnet 243, respectively (discussed below). When any of the magnets 216, 233, 243 are close by, the respective Hall-effect sensor activated by the respective magnet sends a particular voltage signal output (which has been changed due to the presence of a magnetic field) back to the controller 191, for various control purposes (discussed below).

Figure 2:
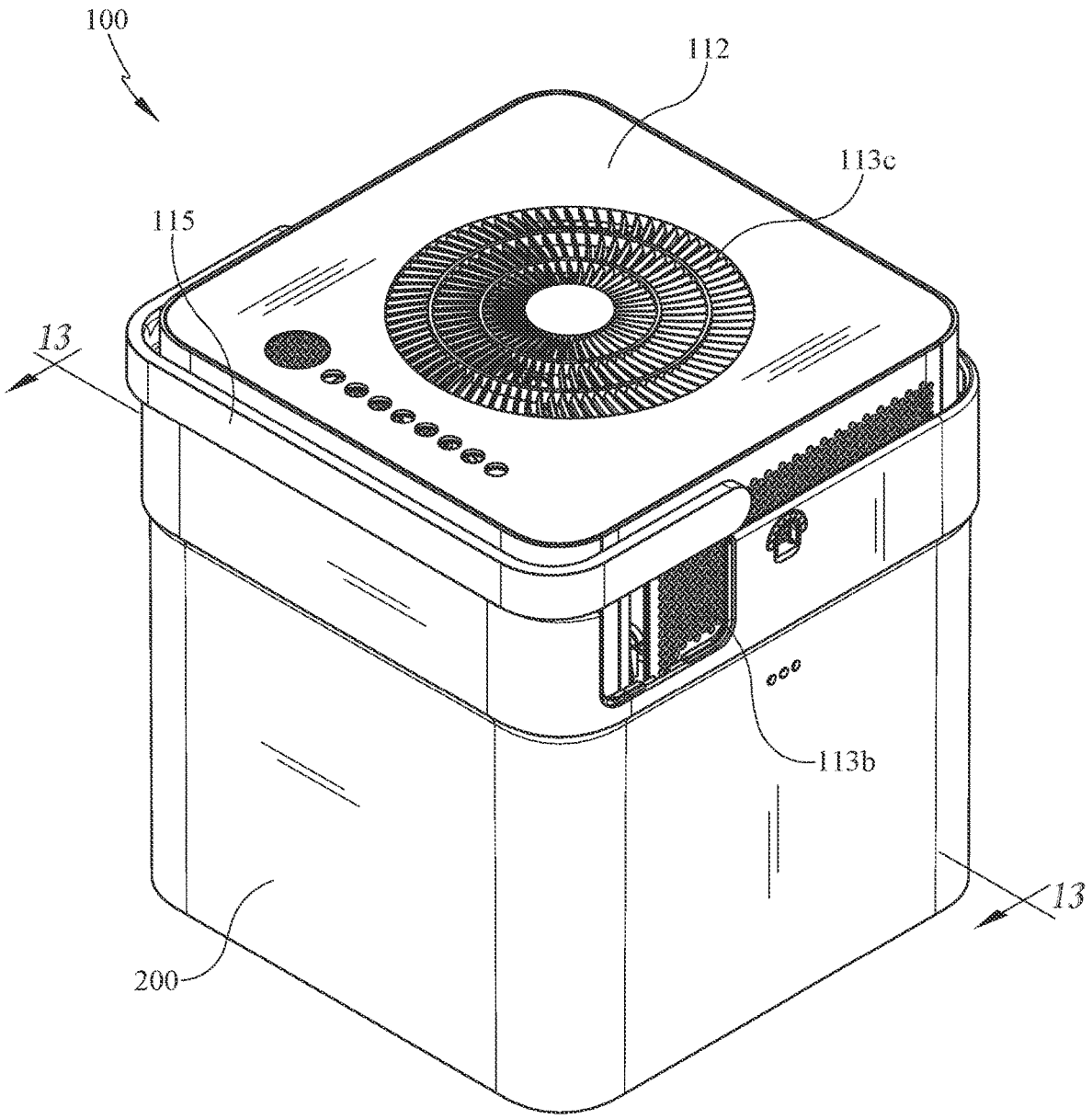
FIG. 2 is a perspective view of the dehumidifier of FIG. 1, shown in a fully nested configuration.
Figure 3:
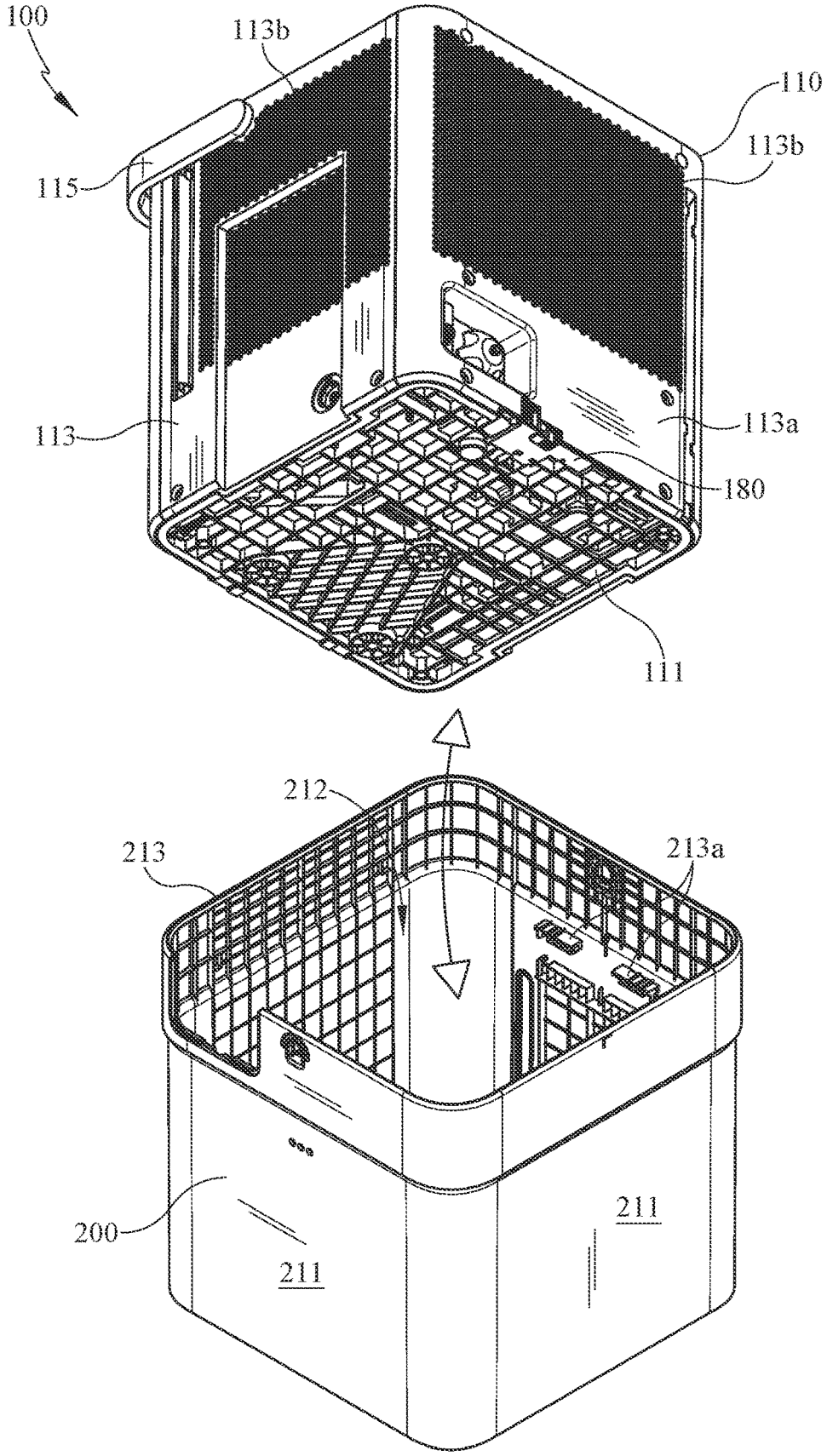
FIG. 3 is an exploded view of the dehumidifier of FIG. 1 with the dehumidifier separated from the condensate tank, according to an embodiment.
Figure 5:
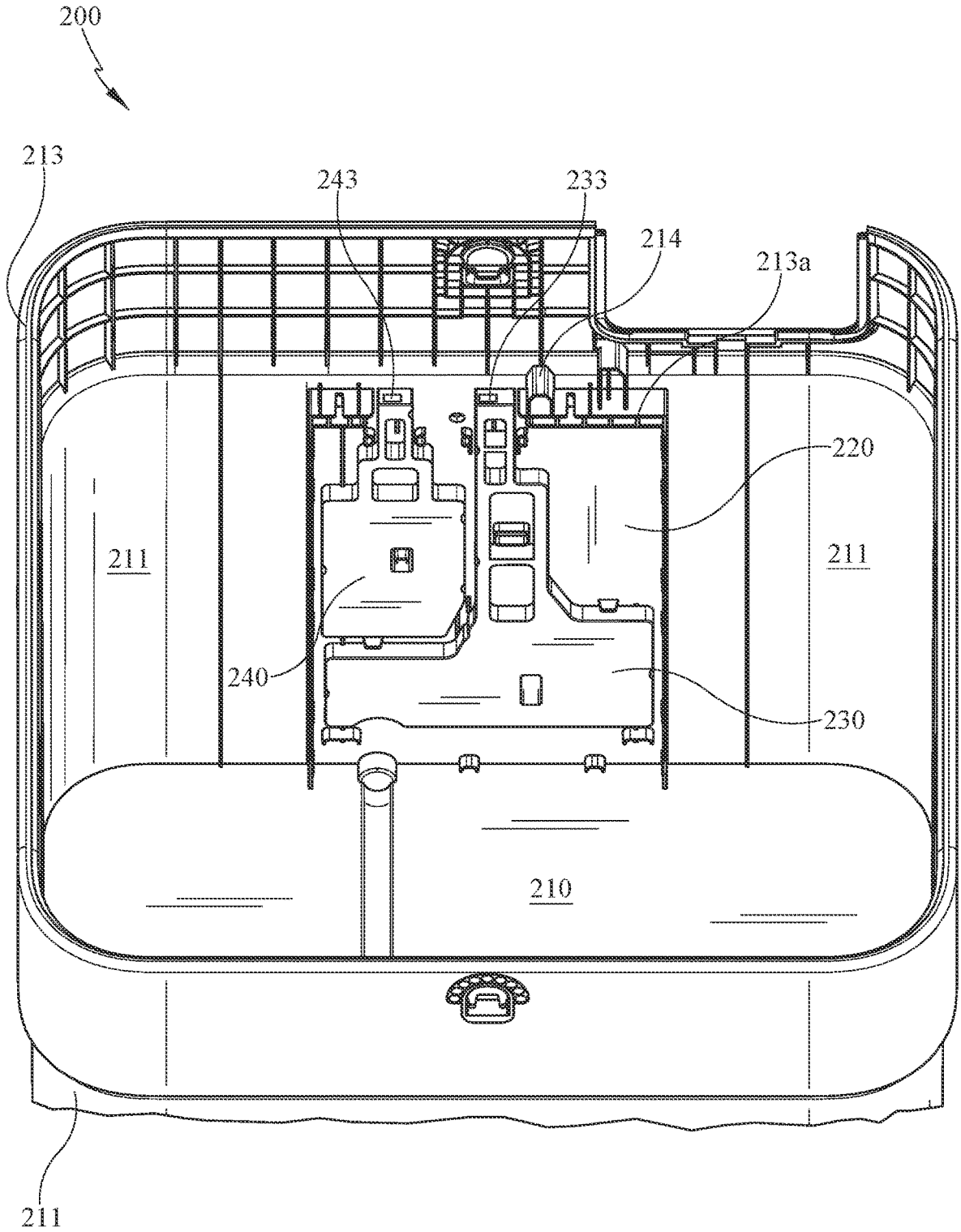
FIG. 5 is a perspective view of the inside of the condensate tank, according to an embodiment, illustrating floats with the float housing cover having been removed for clarity.
Figure 6:
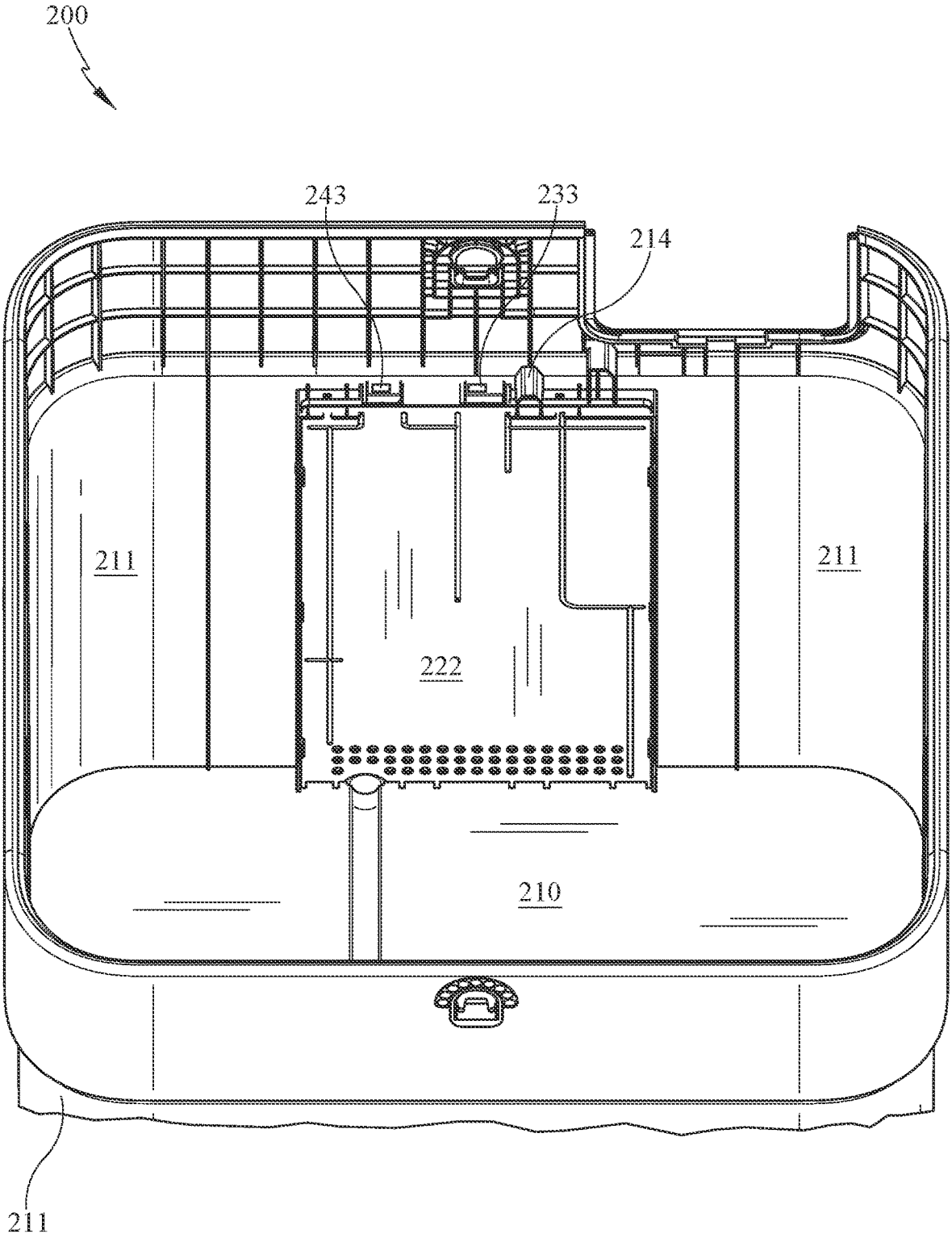
FIG. 6 is a perspective view of the inside of the condensate tank of FIG. 4, showing the float housing cover in place.
Figure 7:
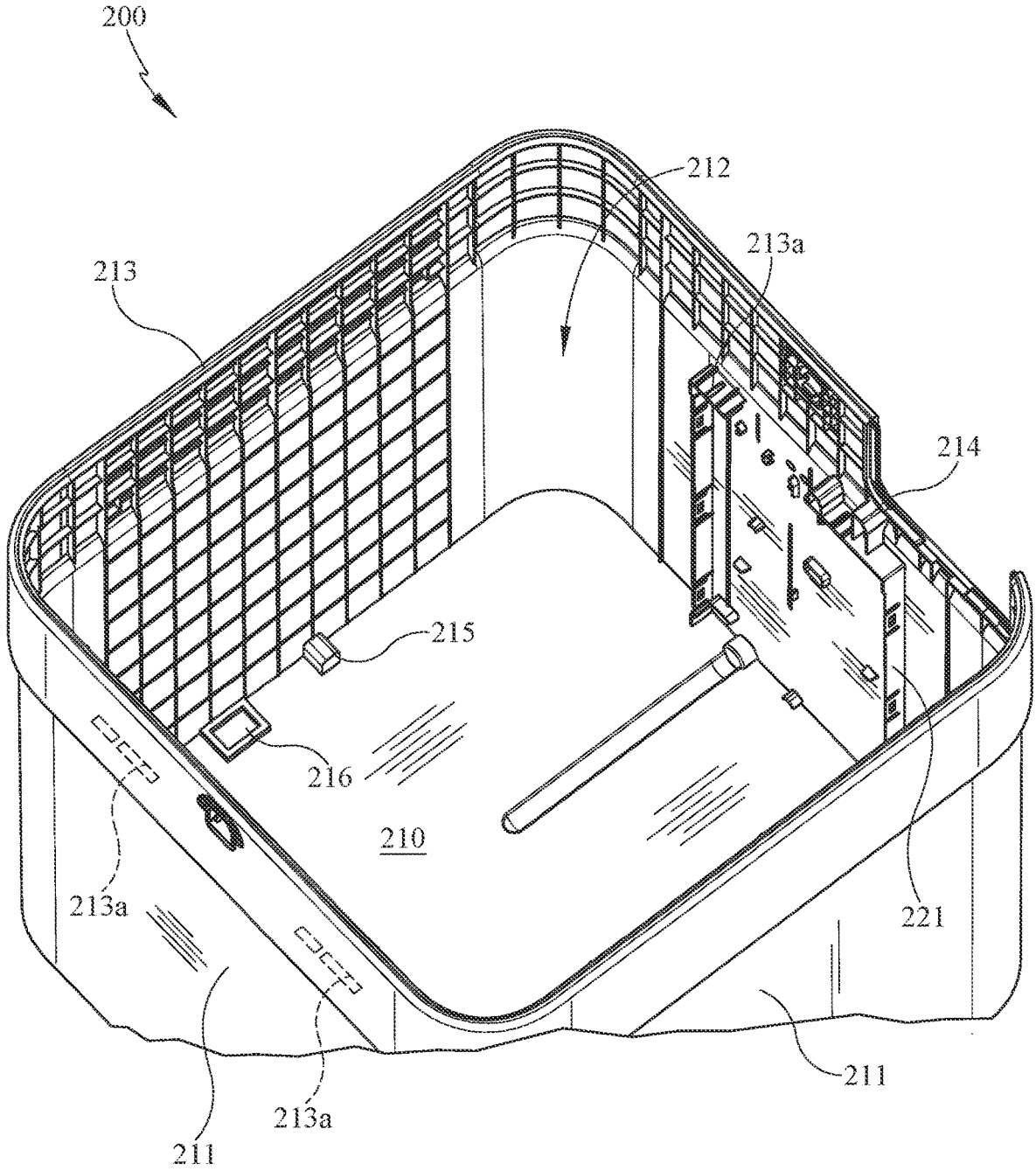
FIG. 7 is perspective view of the bottom inside of the condensate tank, according to an embodiment.

With continued reference to FIGS. 1-3, and reference to FIGS. 5-7, the dehumidifier 100 also includes a condensate tank 200. The condensate tank 200 includes a bottom 210 and one or more sidewalls 211 connected to the bottom 210 to create an internal volume 212 therein. A rim 213 resides at the top of the condensate tank 200 and provides the opening into the internal volume 212. Preferably at or near the rim 213, a first protuberance 214 exists, as shown in FIG. 5. Also, as shown in FIG. 7, a second protuberance 215 exists, which is located at the bottom 210 of the condensate tank 200, as is first magnet 216.

In a nesting dehumidifier 100 such as the embodiments discussed herein, the apparatus 114 can occupy a plurality of configurations, including, but not limited to, a nested configuration and a deployed, or operating, configuration. The deployed and nested configurations are shown, generally, in FIGS. 1 and 2.

In the deployed, or operational, configuration (see FIG. 1), the apparatus 114 is placed atop the condensate tank 200, and specifically, sits on one or more ledges 213*a*, in, on, or slightly within the rim 213. In particular, when in the deployed configuration, the first protuberance 214 is in contact with the switch 170. In this configuration, the majority of the internal volume 212 is unoccupied and available to receive condensate from the operation of the dehumidifier. Also in this configuration, the majority of the air inlets 113*b* are above the condensate tank 200 and available for proper operation. The first protuberance 214 is provided for physically engaging or interacting with the switch 170 of the apparatus 114. The first protuberance 214 can be a separate structure coupled to the condensate tank 200, or it could be (as shown in the figures) molded into the sidewall 211 of the condensate tank 200. When the apparatus 114 is placed into its deployed configuration (operational mode) atop the ledges 213*a* of the condensate tank 200, the first protuberance 214 physically interacts with the lever of the switch 170. This sends a signal to the controller 191 to indicate the presence of the apparatus 114 in its deployed configuration, as will be discussed below.

In the stowed or nested configuration (FIG. 2), as stated above, the apparatus 114 resides within the internal volume 212 of the condensate tank 200. That is, the outer periphery 113*a* of the housing 110 of the apparatus 114 is of smaller dimensions than are the internal dimensions of the sidewalls 211 of the condensate tank 200. In order to nest the apparatus 114 within the condensate tank 200, in the embodiments shown in FIG. 2, the apparatus 114 is rotated (in this case, 90 degrees) about a vertical axis A-A from its orientation shown in FIG. 1. When nested, the bottom 111 of the dehumidifier 100 is adjacent the bottom 210 of the condensate tank 200. In this configuration, the majority of the internal volume 212 is taken up by the housing 110 of the apparatus 114. This also means that the majority of the air inlets 113*b* are blocked or partially blocked by the sidewalls 211 of the condensate tank 200. So, when the dehumidifier 100 is nested within the condensate tank 200, it is not desirable to have the dehumidifier 100 operational because it could create undesirable situations (e.g., overheating due to inadequate air flow; intaking water through the air inlets 113*b*; and so forth). It is also not desirable to have it operational while nested because the apparatus 100 takes up most of the internal volume 212, which leaves insufficient room for much condensate. Therefore, the condensate level in the condensate tank 200 could easily overflow, causing leaks and other undesirable situations.

To overcome these possible issues of having the dehumidifier 100 operate while in the stowed or nested configuration, the condensate tank 200 includes a second protuberance 215 located on the bottom 210 and also includes a first magnet 216 (FIG. 7) on the bottom 210. The second protuberance 215 is provided for physically engaging or interacting with the switch 170 of the apparatus 114. The second protuberance 215 can be a separate structure coupled to the condensate tank 200, or it could be (as shown in the figures) molded into the bottom 210 of the condensate tank 200. When the condensate tank 200 is placed into its nested, or stowed, configuration within the condensate tank 200, the second protuberance 215 physically interacts with the lever of the switch 170. This sends a signal to the controller 191 to indicate the presence of the apparatus 114 in its stowed configuration. The first magnet 216 is located in a position such that when the apparatus 114 is nested within the condensate tank 200 and the second protuberance 215 has engaged the lever of the switch 170, the first magnet 216 is directly under the Hall-effect sensor 180 and in close enough proximity to trigger the Hall-effect sensor 180.

With particular reference to FIGS. 5-6, the condensate tank 200 as shown in the embodiments also includes a float sensor housing 220 to receive one or more floats of the apparatus 114. The float sensor housing 220 includes multiple housing sidewalls 221 and a housing cover 222. Within the float sensor housing 220 resides a first float 230 and a second float 240. The first float 230 includes a body 231 and a first end 232. The second float 240 includes a body 241 and a first end 242. A first float magnet 233 resides in the first end 232 of the first float 230, and a second float magnet 243 resides in the first end 242 of the second float 240. These magnets 233, 243, respectively, serve to activate each one of the first Hall-effect sensor 181 and second Hall-effect sensor 182, respectively, located in the Hall-effect sensor assembly 180 in the bottom 111 of the apparatus 114, if and when they move into sufficient proximity thereto.

The bodies 231, 241 of the first and second floats 220, 230 are shaped, positioned, and coupled to the condensate tank 200 such that each will begin floating within the condensate contained within the condensate tank 200 at different, predetermined levels of liquid, each by desired design/outcome. For example, the first float 230 may be shaped and positioned such that it begins to float when the level of liquid in the condensate tank 200 reaches a particular fill level, for example Fill Level 1 at X % (e.g., 10%, 25%, etc.). Once the first float 230 floats, first float magnet 233 is brought into sufficient proximity to the first Hall-effect sensor 181 to activate it. The output of this activation could be any number of activities, such as, for example, sending a signal to the controller 191 of the apparatus 114 and/or to a user that condensate exists within the internal volume 212 in an amount that is approximately 25% full. The determination of volume from fill level can be done in many known ways, including, but not limited to, using sensors to simply detect a height level of liquid; or performing a volume calculation based on a height level, and so forth. Similarly, for example, the second float 240 may be shaped and positioned such that it begins to float when the level of liquid in the condensate tank 200 reaches a different level, for example Fill Level 2, or Y % (e.g., 75%, 80%, 90%, etc.). Once the second float 240 floats, second float magnet 243 is brought into sufficient proximity to the second Hall-effect sensor 182 to activate it. The output of this activation could be any number of activities, such as, for example, sending a signal to the controller 191 of the apparatus 114 and/or to a user that condensate exists within the internal volume 212 in an amount that is full or approximately full, for example.

Figure 8:
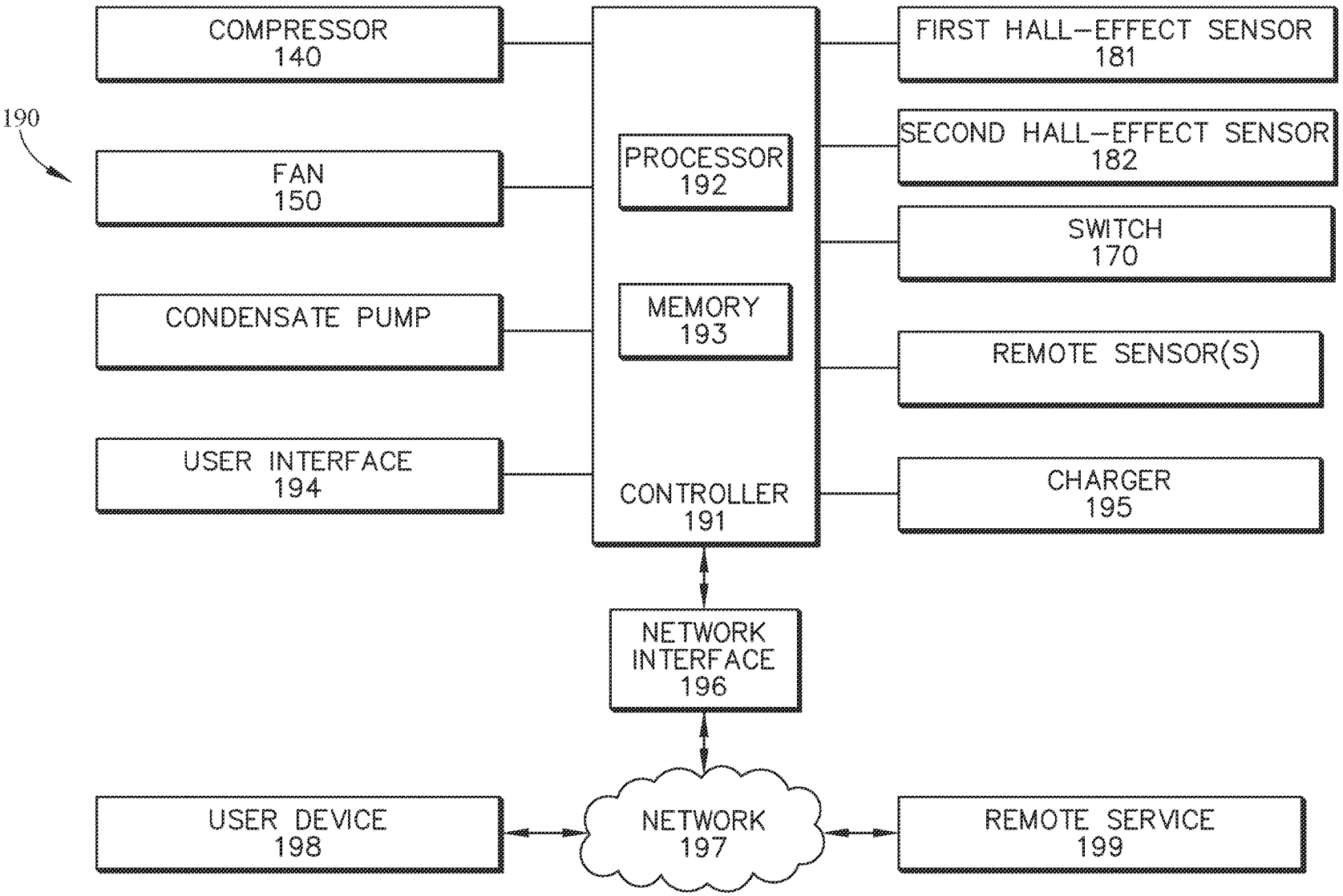
FIG. 8 is a block diagram of an example control system for a portable dehumidifier consistent with some of the embodiments described herein.

FIG. 8 is a block diagram representing an example control system 190 for the dehumidifier 100 described herein. In the exemplary system, a dehumidifier 100 may be under the control of a controller 191 that receives inputs from a number of components and drives a number of components in response thereto. Controller 191 may, for example, include one or more processors 192 and a memory 193 within which may be stored program code for execution by the one or more processors 192. The memory 193 may be embedded in controller 191, but may also be considered to include volatile and/or non-volatile memories, cache memories, flash memories, programmable read-only memories, read-only memories, etc., as well as memory storage physically located elsewhere from controller 191, e.g., in a mass storage device or on a remote computer interfaced with controller 191. Controller 191 may also be implemented as a microcontroller in some embodiments, and as such these terms are used interchangeably herein. Controller 191 may also include discrete circuit logic in some embodiments, e.g., including passive and/or active circuit components.

As shown in FIG. 8, controller 191 may be interfaced with various components, including the compressor 140 that drives the refrigeration circuit, the fan 150 that draws air through the dehumidifier, and in some instances, a condensate pump, if present that is capable of pumping collected water to a drain or other destination. In addition, one or more user interfaces 194, e.g., including various input/output devices such as knobs, dials, sliders, switches, buttons, lights, textual and/or graphics displays, touch screen displays, speakers, image capture devices, microphones, etc., may be used for receiving input from and communicating with one or more users.

In addition, controller 191 may be coupled to one or more integrated sensors or switches, such as first Hall-effect sensor 181, second Hall-effect sensor 182, as well as switch 170. Also, one or more remote sensors could be employed, if desired. Additional on-board sensors could be integrated in some manner into the housing 110 and/or the condensate tank 200, and thus may be local to the dehumidifier 100 itself if desired. A remote sensor, if present, may be any type of sensor that is coupled wirelessly or through a wire to the main unit or housing of the portable dehumidifier, but that is capable of being positioned some distance away from the main unit or housing, limited, for example, by the length of the wire or cord coupling the sensor to the main unit or housing, or by the wireless communication range between the main unit or housing and the remote sensor. Any of such sensors may sense various environmental conditions, e.g., humidity, temperature, surface moisture, water level, etc., and it will be appreciated in some portable dehumidifiers consistent with the invention, any number of integrated sensor or remote sensors may be omitted.

Further, where any remote sensor is wireless, it may also be desirable to include a charger 195 capable of charging a battery of the remote sensor when it is docked in a dock, e.g., via wireless charging or via charging contacts on the remote sensor.

In some embodiments, controller 191 may also be coupled to one or more network interfaces 196, e.g., for interfacing with external devices via wired and/or wireless networks 197 such as Ethernet, Bluetooth, NFC, cellular and other suitable networks. It may be desirable, for example, to interface with one or more user devices 198, e.g., a user's mobile phone, to enable a user to change settings on the portable dehumidifier and/or receive notifications such as drying complete notifications. It may also be desirable to interface with various remote services 199. Moreover, in some embodiments, at least a portion of controller 191 may be implemented externally, e.g., within a mobile device, a cloud computing environment, etc., such that at least a portion of the functionality described herein is implemented within the portion of the controller that is externally implemented.

Figure 9:
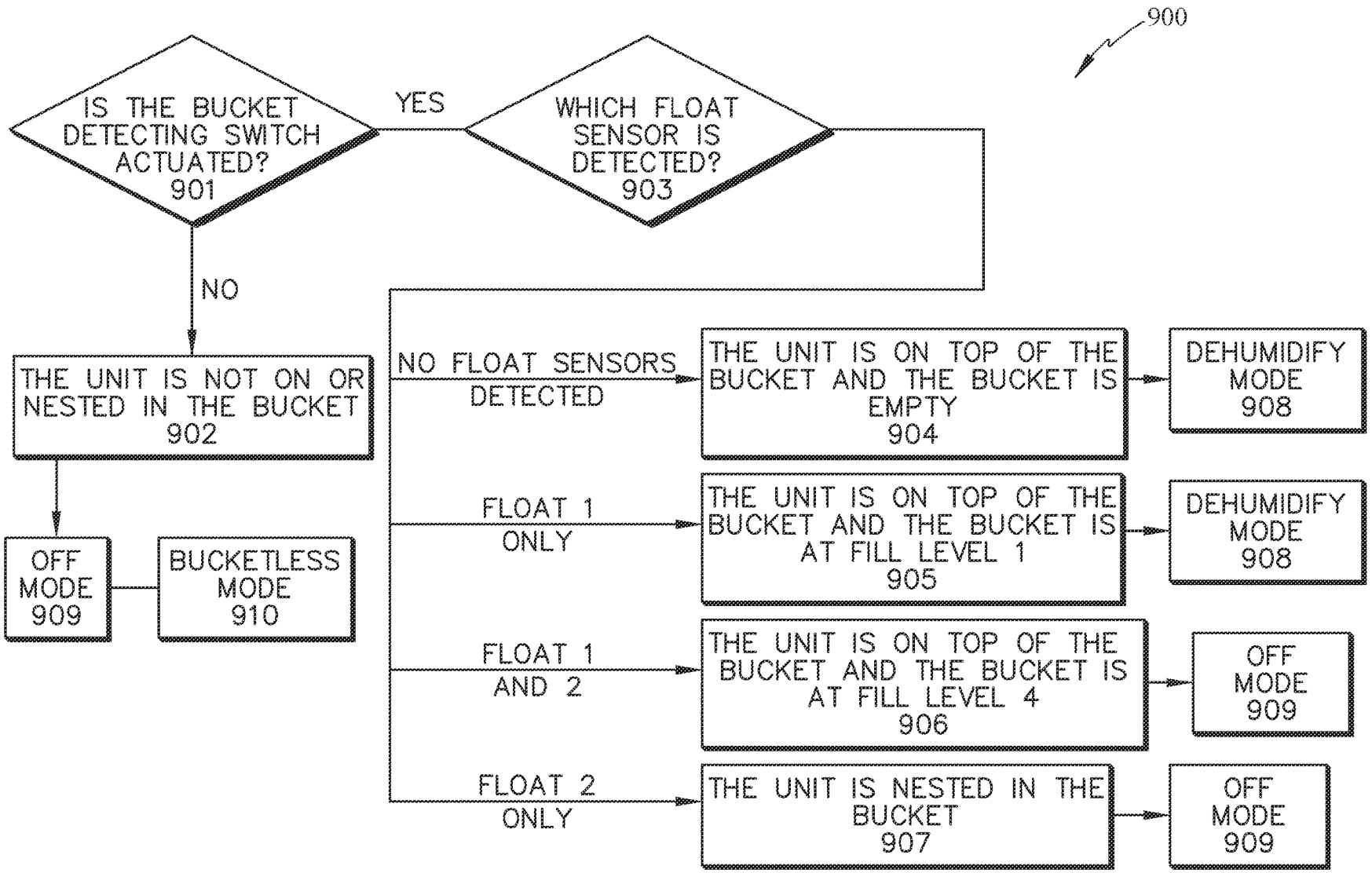
FIG. 9 is a diagram of the control logic for the dehumidifier of FIG. 1, according to an embodiment.

In some embodiments, controller 191 may operate under the control of an operating system and may execute or otherwise rely upon various computer software applications, components, programs, objects, modules, data structures, etc. In addition, controller 191 may also incorporate hardware logic to implement some or all of the functionality disclosed herein. Further, in some embodiments, the sequences of operations performed by controller 191 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein FIG. 9 illustrates a sample flow diagram for a logical control sequence of operations 900 for the dehumidifier 100. In the embodiments described herein, the controller 191 supports, at least, a Dehumidify mode of operation, wherein the dehumidifier 100 is operating to reduce the humidity within a given area, and an Off mode, wherein the dehumidifier is not operational. Other modes are possible, and indeed other types of sensors can be used to trigger on/off such additional modes, based on the outputs of such sensor.

In the illustrated embodiment, the Dehumidify mode may be considered to operate, as but one example, based upon a room humidity control algorithm that utilizes the output of one or more moisture sensors, e.g., one or more remote moisture sensors and/or one or more integrated moisture sensors, to control a compressor and motor of the dehumidifier 100 to attempt to maintain a desired humidity level in the room or other area in which the dehumidifier 100 is disposed. In one example algorithm, for example, a humidity level setpoint may be selected by a user, e.g., in terms of % relative humidity, and activate and deactivate criteria may be defined to establish when to activate and deactivate a compressor and motor in order to maintain a desired humidity level, e.g., to activate the compressor and motor when the sensed humidity level is W % greater than the humidity level setpoint and deactivate the compressor and motor when the sensed humidity level is Z % below the humidity level setpoint. In some embodiments, the sensed humidity level may be based upon multiple sensor outputs, e.g., by averaging the outputs of sensors positioned in different areas of a room and/or an integrated sensor disposed in the portable dehumidifier housing. Further, in some embodiments the motor speed, and thus the rate of air flow, may also be controlled based upon a room humidity control algorithm, although in other embodiments a motor speed may be controlled via a user control, such that the algorithm only controls whether the fan is or is not active at any given time.

But, as discussed above, in all of these possible Dehumidify scenarios, it is desirable to be able to determine whether the dehumidifier 100 is nested within the condensate tank 200, so as to be able to turn off the dehumidifier 100, or to prevent activation, when this condition exists. Obviously the methods of turning off the dehumidifier 100 are numerous, and include, for example, simply having the user manually input such selection (via a user interface, whether on the dehumidifier or remote therefrom). The embodiments disclosed herein are directed to providing an ability to, automatically if desired, use the presence of the apparatus 114 within the condensate tank 200 (that is, based on the nested/not nested status of the apparatus 114 within the internal volume 212 of the condensate tank 200 (via second protuberance 215 activating switch 170)) as the means to turn off (or prevent turning on) the dehumidifier 100.

Sequence 900 therefore begins in block 901 by determining whether the switch 170 has been activated. As described above, the switch 170 can be activated by either the first protuberance 214 (when the dehumidifier 100 is in the operating configuration atop (FIG. 1) the condensate tank 200) or the second protuberance 215 (when the dehumidifier 100 is in the stowed or nested configuration within (FIG. 2) the condensate tank 200). If the switch 170 has not been activated, control passes to block 902, which activates one of several possible modes, including an Off mode (block 909) or deactivation sequence to either power down the dehumidifier 100 (if already operating) or to not enable powering up the dehumidifier 100 (if not already operating). This condition exists because neither the first protuberance 214 nor the second protuberance 215 have engaged the switch 170, which means that the apparatus 114 is neither atop nor within the condensate tank 200. This would generally indicate that the apparatus 114 is separated from the condensate tank 200 altogether, that is, a "bucketless mode", so it would not be desirable to operate the dehumidifier 100 without some further action required by a user (for example, requiring a double-button press within a certain time period, in the event the user affirmatively desires to operate the dehumidifier in this bucketless mode, block 910). An example of such a desire instance would be where a user has connected the dehumidifier 100 to a proper drain hose.

If the switch 170 has been actuated (block 903), the control system then determines whether any of the float magnets (e.g., first float magnet 233 and/or second float magnet 243) have been detected by the first Hall-effect sensor 181 or the second Hall-effect sensor 182, respectively. As discussed above, first float 230 includes a first float magnet 233 at a first end 232 of the first float 230. Similarly, second float 240 includes a second float magnet 243 at a first end 242 of the second float 240. Also as discussed above, the condensate tank 200 includes a first magnet 216. The first magnet 216 is positioned on the bottom 210 of the condensate tank 200 in a location such that it resides beneath the second Hall-effect sensor 182.

Figure 10:
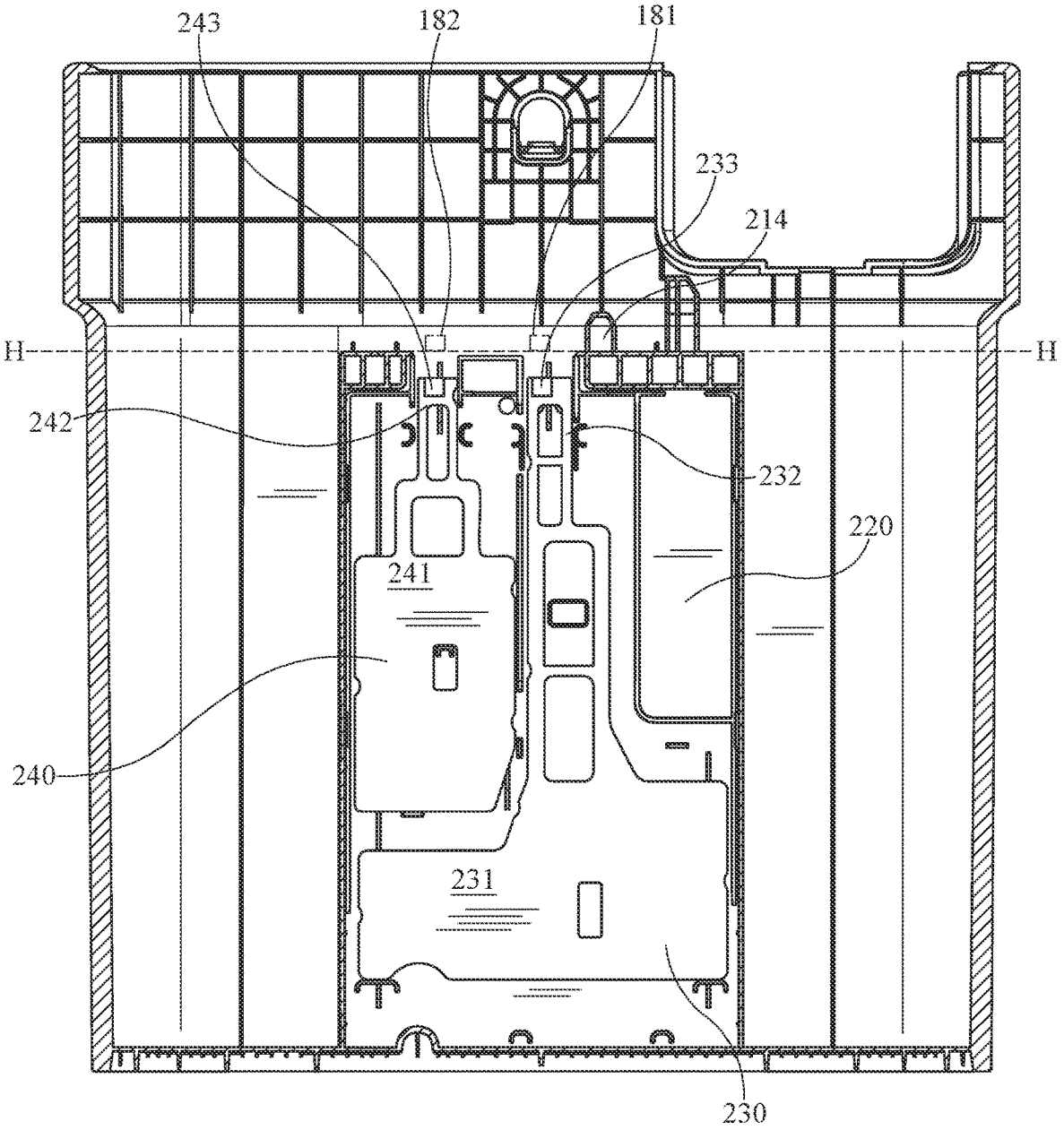
FIG. 10 is a cutaway elevation view of the float switches indicating an empty bucket.
Figure 11:
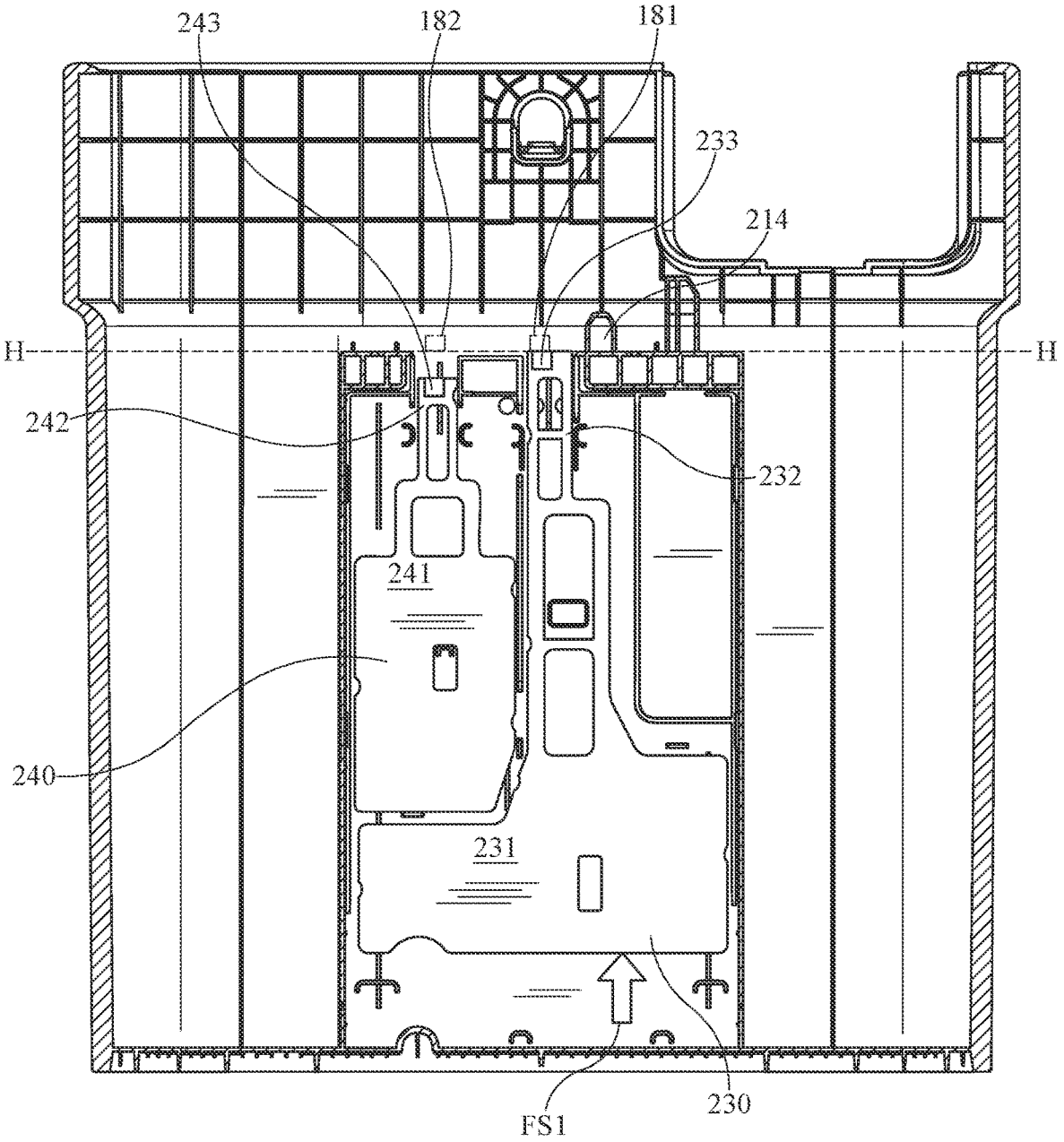
FIG. 11 a cutaway elevation view of the float switches indicating a first fill level.
Figure 12:
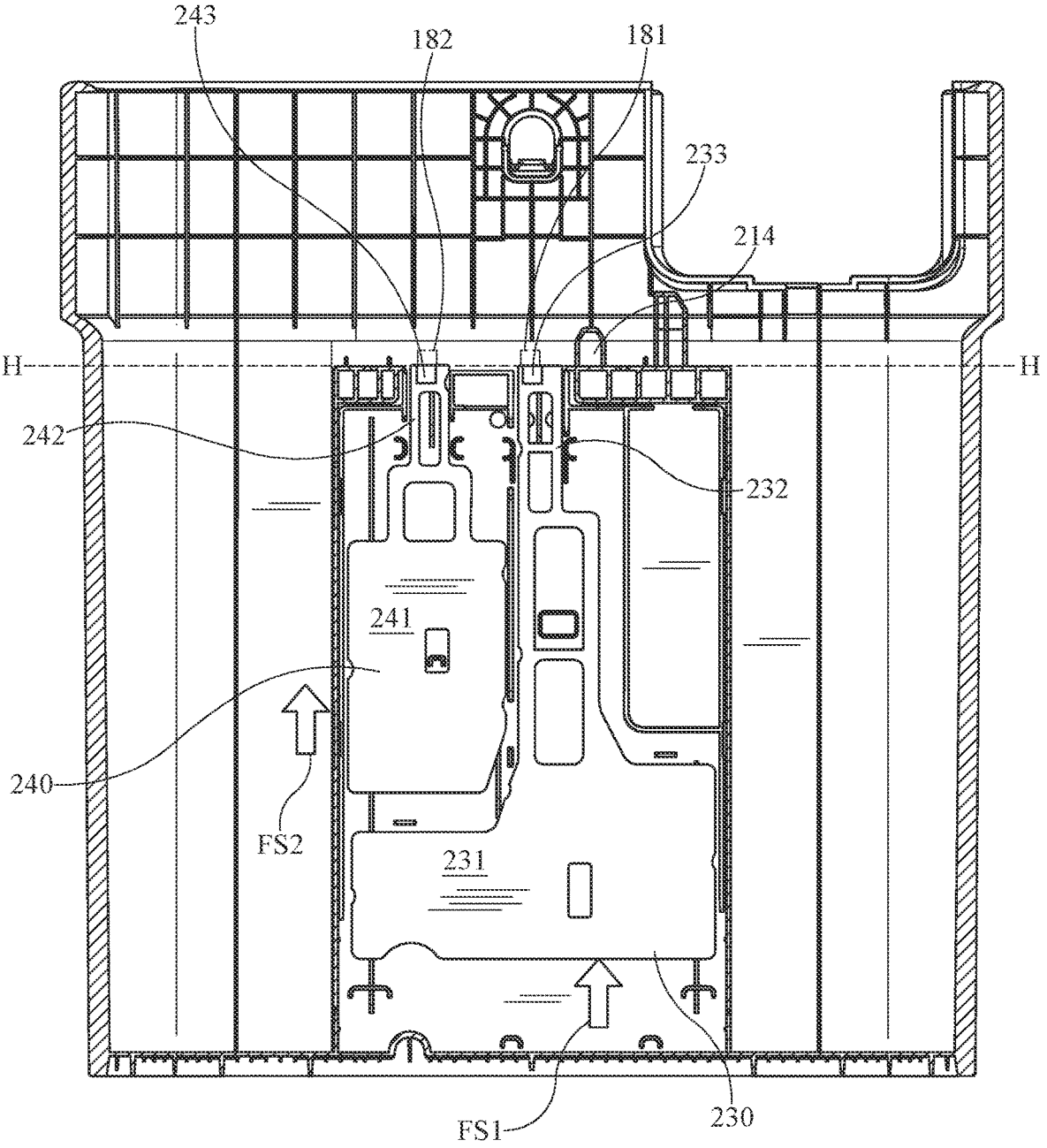
FIG. 12 is a cutaway elevation view of the float switches indicating a second fill level.

The controller 191 determines whether any of these three magnets 233, 243, 216 (and if so, which one(s)), have been detected. FIGS. 10-12 depict the condensate tank 200 in varying conditions, with the first float 230 and second float 240 occupying varying positions. In these figures, horizontal line H-H has been drawn to indicate the horizontal elevation in which the first Hall-effect sensor 181 and the second Hall-effect sensor 182 will sense the presence of a magnetic field when the apparatus 114 is in the deployed/operating configuration (as in FIG. 1). As shown in FIG. 10, the first float 230 and the second float 240 are in their rest positions, meaning that neither has moved upward (floated). As a result, as depicted in block 904 of FIG. 9, neither the first float magnet 233 nor the second float magnet 243 is close enough to line H-H to activate either the first Hall-effect sensor 181 or the second Hall-effect sensor 182. This situation indicates that the apparatus 114 is atop the condensate tank 200 (because the switch 170 has been actuated), and the condensate tank 200 is empty (because no float sensors have risen to activate either the first Hall-effect sensor 181 or the second Hall-effect sensor 182). In this situation, therefore, the dehumidifier 100 is ready for operation atop the condensate tank 200, and can be turned on as desired (Dehumidify mode, block 908), or, if already on, remain on, by the controller 191.

FIG. 11 depicts the situation wherein only first float 230 has floated, as indicated by the open arrow FS1. This vertical movement places the first float magnet 233 at line H-H, thus activating the first Hall-effect sensor 181. This situation is depicted in block 905 of FIG. 9. This situation indicates that the apparatus 114 is atop the condensate tank 200 (because the switch 170 has been actuated), and the condensate tank 200 contains condensate within the internal volume 212 at a level equal to Fill Level 1. In this situation, the dehumidifier 100 is either in operation, or ready for operation, as desired (that is, can be in Dehumidify mode, block 908), because (a) the apparatus 114 is in the deployed configuration atop the condensate tank 200, and the condensate tank 200 contains only a small volume of liquid (equal to predetermined Fill Level 1).

FIG. 12 depicts the situation wherein both first float 230 and second float 240 have floated, as indicated by the open arrows FS1 and FS2. This vertical movement places both the first float magnet 233 and the second float magnet 243 at line H-H, which means that first float magnet 233 activates first Hall-effect sensor 181 and second float magnet 243 activates second Hall-effect sensor 182. This corresponds to block 906 of FIG. 9. This situation indicates that the apparatus 114 is atop the condensate tank 200 (because the switch 170 has been actuated), and the condensate tank 200 contains condensate within the internal volume 212 at a level equal to Fill Level 2 (because second float 240 has risen to be place the second float magnet 243 into close proximity to activate the second Hall-effect sensor 182). Depending on what percentage full Fill Level 2 has been set to, this condition might indicate that it is time to empty the condensate tank 200, or is nearing the time to empty it. This also might enable the controller 191 to deactivate the dehumidifier 100 so that the condensate tank 200 does not overflow, that is enter an Off mode, block 909.

As discussed previously, the first and second floats 230, 240, are designed to float at different levels of liquid within the condensate tank 200. First float 230 floats at a Fill Level 1, and second float 240 floats at Fill Level 2, where Fill Level 2 is higher than Fill Level 1. Stated otherwise, if there is liquid within the condensate tank 200 at a fill level adequate to float the second float 240, the liquid would have also necessarily floated the first float 230, because the first float 230 floats at a first, lower fill level.

Figure 13:
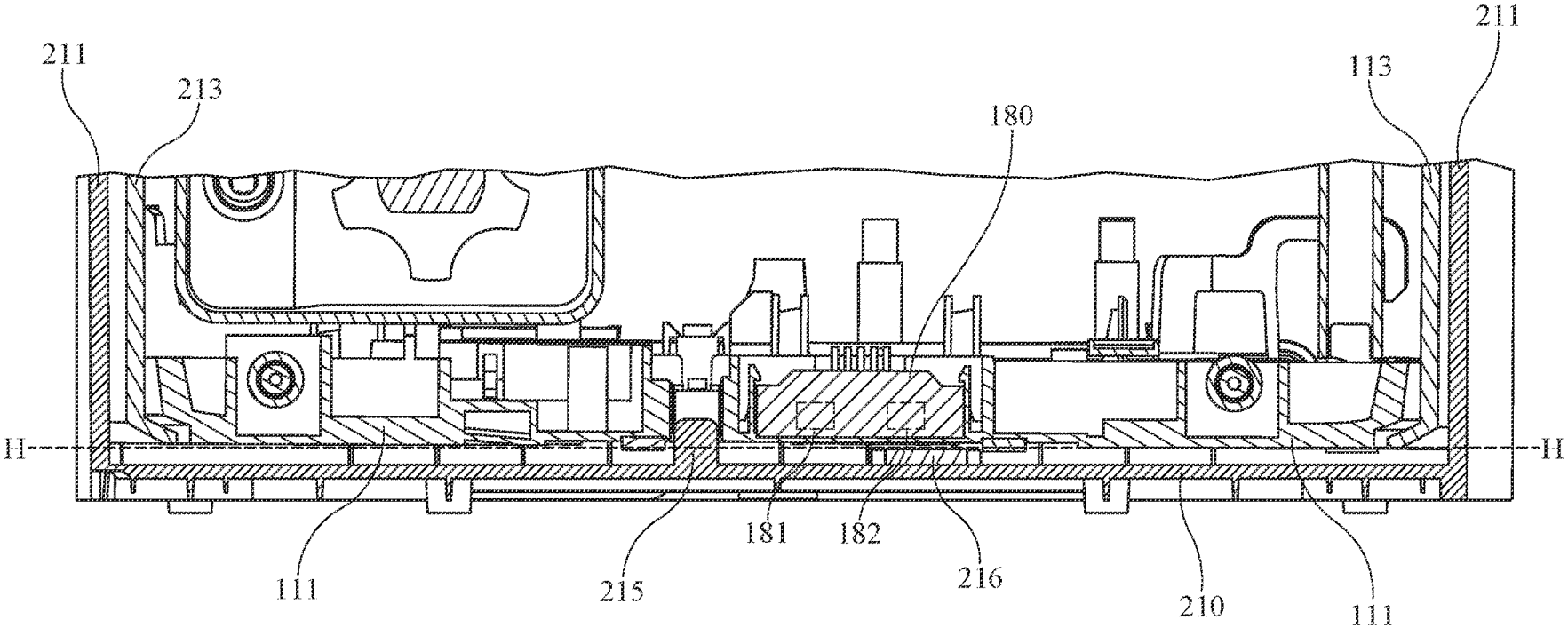
FIG. 13 is a partial sectional view taken from section line 13-13 of FIG. 2, showing the interaction of the bottom of the dehumidifier and the bottom of the condensate tank.

FIG. 13 is a partial sectional view taken at line 13-13 of FIG. 2, showing the bottom portion of the dehumidifier and the condensate tank 200 when the apparatus 114 is nested within the condensate tank 200. Line H-H is also depicted in this figure, which again represents the location of the activation elevation of the first Hall-effect sensor 181 and second Hall-effect sensor 182. As discussed above, when the apparatus 114 is fully nested within the condensate tank 200, the second protuberance 215 (not the first protuberance 214) activates the switch 170. Also as discussed above, the first magnet 216 is located in the bottom 210 of the condensate tank 200 in a position beneath the second Hall-effect sensor 182. More particularly, the first magnet 216 is placed in the same x-y location such that first magnet 216 activates the same Hall-effect sensor (that is, second Hall-effect sensor 182) as would the second float magnet 243. Therefore, in the nested configuration, the dehumidifier 100 provides the scenario (corresponding to block 907 of FIG. 9) that the Hall-effect sensor assembly 180 senses what appears to be only the second float magnet 243, as opposed to sensing both the first float magnet 233 and the second float magnet 243 discussed with regard to FIG. 12 above. And, as discussed earlier, if liquid is present in the condensate tank 200 at a level adequate to float the second float 240, the first float 230 also would necessarily also have floated and activated the first Hall-effect sensor 181. As a result, the only way possible for only the second float 240 to activate the second Hall-effect sensor 182 is for the first magnet 216—as opposed to the second float magnet 243—to be the magnet that is activating the second Hall-effect sensor 182. Therefore, this situation indicates that (a) the apparatus 114 is in its stowed configuration nested within the condensate tank 200; (b) the switch 170 has been actuated by the second protuberance 215; and (c) the first magnet 216 is in close proximity to activate the second Hall-effect sensor 182. In this situation, the controller 191 can prevent the dehumidifier 100 from operating (that is, enter an Off mode, block 909), because, as discussed previously, it is not desirable to operate the dehumidifier 100 when the apparatus 114 is nested within the condensate tank 200.

Various embodiments are contemplated to achieve the safety results described above for the embodiment shown in the figures. For example, rather than using the first magnet 216 to trigger a Hall-effect sensor and using the logic therefor to determine that the apparatus 114 is nested within the condensate tank 200, one or more sensors of different design may be utilized. For example, one or more ultrasonic sensors may be employed within the logic and control system 190 to determine different distances between the apparatus 114 and the condensate tank 200 for the nested versus the operational (non-nested) condition. Or, an infrared sensor could be employed to detect a different color for the bottom 210 of the condensate tank 200 as opposed to an absence of the bottom 210. Or, additional or alternative features could be added and located somewhere on the condensate tank 200 to actuate a different switch, which could be employed in the control system 190 to achieve other desired outcomes (e.g., power on, power off, alert a user of a status, provide visible or audible alarms, and so forth).

And, of course, any of the sensors described herein could be of different type, depending on preference, and additional sensors could be employed to facilitate the control system 190 function, as well as additional control functions. Such types of sensors could include, but not be limited to, temperature, proximity, accelerometer, IR, pressure, light, ultrasonic, smoke, gas, touch, color, humidity, position, tilt, flow, PIR, and other types of optical, electrical, electromechanical, and mechanical sensors.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dehumidifier comprising:

a dehumidifier housing having a bottom, one or more sidewalls, and a top, said housing including at least a compressor, a condenser, an evaporator, a fan, a switch, and a Hall-effect sensor;

a condensate tank further comprising a condensate tank housing having a bottom, one or more sidewalls, and a rim defining an opening into an internal volume within said condensate tank housing, wherein said dehumidifier housing is configured to occupy a plurality of configurations with respect to the condensate tank, including a first configuration in which said dehumidifier housing is atop said condensate tank, and a second configuration in which said dehumidifier housing is nested within said internal volume of said condensate tank; wherein a portion of said internal volume of said condensate tank is unoccupied by said dehumidifier housing when said dehumidifier housing is in said first configuration, and a portion of said internal volume of said condensate tank is occupied by said dehumidifier housing when said dehumidifier housing is in said second configuration; and wherein said condensate tank housing has a ledge adjacent said opening;

at least one float coupled to said condensate tank housing configured to rise with a predetermined level of liquid within said internal volume of said condensate tank;

a first protuberance at a first location on the condensate tank;

a second protuberance at a second location on the condensate tank, a magnet coupled to said bottom of said condensate tank and located beneath and adjacent to said Hall-effect sensor when said condensate tank is in said second configuration;

wherein said at least one float further comprises a first float and a second float, wherein said first float is configured to float at a first liquid level within said condensate tank, wherein said second float is configured to float at a second liquid level within said condensate tank, and wherein said second liquid level is greater than said first liquid level, a second Hall-effect sensor; and wherein said first float further comprises a first float magnet and said second float further comprises a second float magnet.

2. The dehumidifier of claim 1 wherein said first location is adjacent said rim of said condensate tank.

3. The dehumidifier of claim 1 wherein said second location is adjacent said bottom of said condensate tank.

4. The dehumidifier of claim 3 wherein said dehumidifier housing in said second configuration is in a first orientation with respect to said condensate tank housing and wherein said dehumidifier housing in said first configuration is in a second orientation with respect to said condensate tank housing, and wherein said first orientation is different from said second orientation about a vertical axis.

5. The dehumidifier of claim 4 wherein at least one of said first float and/or said second float further comprises a body and a first end disposed closer to said rim than is said body.

6. The dehumidifier of claim 5 wherein said first end of said first float includes said first float magnet and said first end of said second float includes said second float magnet.

7. The dehumidifier of claim 6 wherein said first float magnet is located adjacent to said Hall-effect sensor when said dehumidifier housing is in said first configuration and the liquid within said condensate tank reaches said first liquid level.

8. The dehumidifier of claim 1 wherein said first float magnet is adjacent to said Hall-effect sensor when the liquid in said condensate tank is at said first liquid level.

9. The dehumidifier of claim 8 wherein said second float magnet is adjacent to said second Hall-effect sensor when the liquid in said condensate tank is at said second liquid level.

10. The dehumidifier of claim 9 further comprising a controller configured to receive a first voltage output from said Hall-effect sensor when the liquid in said condensate tank is at said first liquid level, and is configured to receive a second voltage output from said second Hall-effect sensor when the liquid in said condensate tank is at said second liquid level.

11. The dehumidifier of claim 10 wherein said controller is configured to receive said second voltage output from said second Hall-effect sensor when said dehumidifier is in said second configuration.

12. The dehumidifier of claim 11 wherein said controller activates an Off mode when said second voltage output from said second Hall-effect sensor is received and when said second protuberance activates said switch.

13. The dehumidifier of claim 1 further comprising a controller configured to receive a signal from said switch when said second protuberance activates said switch.

14. The dehumidifier of claim 13 wherein said controller is also configured to receive a first voltage output from said Hall-effect sensor when said dehumidifier is in said second configuration.

15. The dehumidifier of claim 14 wherein said controller activates an Off mode when said first voltage output from said Hall-effect sensor is received and when said second protuberance activates said switch.

16. A dehumidifier comprising:

a dehumidifier housing having a bottom, one or more sidewalls, and a top, said housing including at least a compressor, a condenser, an evaporator, a fan, a switch, and a Hall-effect sensor;

a condensate tank further comprising a condensate tank housing having a bottom, one or more sidewalls, and a rim defining an opening into an internal volume within said condensate tank housing, wherein said dehumidifier housing is configured to occupy a plurality of configurations with respect to the condensate tank, including a first configuration in which said dehumidifier housing is atop said condensate tank, and a second configuration in which said dehumidifier housing is nested within said internal volume of said condensate tank; wherein a portion of said internal volume of said condensate tank is unoccupied by said dehumidifier housing when said dehumidifier housing is in said first configuration, and a portion of said internal volume of said condensate tank is occupied by said dehumidifier housing when said dehumidifier housing is in said second configuration; and wherein said condensate tank housing has a ledge adjacent said opening;

at least one float coupled to said condensate tank housing configured to rise with a predetermined level of liquid within said internal volume of said condensate tank;

a first protuberance at a first location on the condensate tank activates said switch when said dehumidifier housing is in said first configuration;

a second protuberance at a second location on the condensate tank activates said switch when said dehumidifier housing is in said second configuration, a magnet coupled to said bottom of said condensate tank and located beneath and adjacent to said Hall-effect sensor when said condensate tank is in said second configuration.

17. The dehumidifier of claim 16 further comprising a controller configured to receive a signal from said switch when at least one of said second protuberance and/or said first protuberance activates said switch.

18. The dehumidifier of claim 17 wherein said controller is configured to receive a first voltage output from said Hall-effect sensor when said dehumidifier housing is in said second configuration.

19. The dehumidifier of claim 18 wherein said controller activates an Off mode when said first voltage output from said Hall-effect sensor is received and when said second protuberance activates said switch.

20. The dehumidifier of claim 18 wherein said controller is configured to receive said first voltage output from said Hall-effect sensor when said dehumidifier housing is in said first configuration.

21. The dehumidifier of claim 18 wherein said controller is configured to receive a second voltage output from said Hall-effect sensor when said dehumidifier housing is in said first configuration.

22. The dehumidifier of claim 17 wherein one float of said at least one float further comprises a float magnet.

* * * * *